US008061116B2

(12) United States Patent
Lassmann

(10) Patent No.: US 8,061,116 B2
(45) Date of Patent: Nov. 22, 2011

(54) METHOD FOR PIECING A YARN AND ROTOR SPINNING MACHINE FOR CARRYING OUT THE METHOD

(75) Inventor: Manfred Lassmann, Nettetal (DE)

(73) Assignee: Oerlikon Textile GmbH & Co KG, Monchengladbach (DE)

( * ) Notice: Subject to any disclaimer, the term of this patent is extended or adjusted under 35 U.S.C. 154(b) by 328 days.

(21) Appl. No.: 12/086,214

(22) PCT Filed: Nov. 2, 2006

(86) PCT No.: PCT/EP2006/010502

§ 371 (c)(1),
(2), (4) Date: Sep. 24, 2009

(87) PCT Pub. No.: WO2007/065506

PCT Pub. Date: Jun. 14, 2007

(65) Prior Publication Data

US 2010/0071341 A1 Mar. 25, 2010

(30) Foreign Application Priority Data

Dec. 10, 2005 (DE) ..... 10 2005 059 078

(51) Int. Cl.
*D01H 4/50* (2006.01)

(52) U.S. Cl. ..... 57/263; 57/264

(58) Field of Classification Search ..... 57/22, 261, 57/263, 264, 265

See application file for complete search history.

(56) References Cited

U.S. PATENT DOCUMENTS

| | | | | |
|---|---|---|---|---|
| 5,509,261 | A | 4/1996 | Wassenhoven et al. | 57/263 |
| 5,832,709 | A | 11/1998 | Lassmann et al. | 57/263 |
| 6,035,622 | A * | 3/2000 | Fox et al. | 57/263 |
| 6,339,921 | B1 | 1/2002 | Lassmann et al. | 57/264 |
| 7,644,570 | B2 * | 1/2010 | Lassmann | 57/263 |
| 2005/0044841 | A1 | 3/2005 | Brandl et al. | 57/263 |
| 2009/0120052 | A1 * | 5/2009 | Lassmann | 57/263 |

FOREIGN PATENT DOCUMENTS

| | | | |
|---|---|---|---|
| DE | 199 55 674 | A1 | 5/2001 |
| DE | 103 27 370 | A1 | 1/2005 |
| EP | 0 381 995 | A2 | 8/1990 |

OTHER PUBLICATIONS

Raasch H. et al. "Automatisches Anspinnen Beim OE-Rotorspinnen" Melliand Textilberichte, International Textile Reports, Melliand Textilberichte, Frankfurt Am Main, DE, vol. 70, No. 4, Apr. 1, 1989, pp. 251-256, PX000099924, ISSN: 0341-0781.

* cited by examiner

*Primary Examiner* — Shaun R Hurley
(74) *Attorney, Agent, or Firm* — K&L Gates LLP

(57) ABSTRACT

A method for piecing a yarn at a rotor spinning machine comprising plural spinning stations, wherein more than five piecers are successively produced in a measuring phase and coordinates of measurement values and associated measurement values from individual measurements of the piecers are evaluated for averaging and determining a fiber band function taking into account a drafting reduced for the measurement values, which reflects the fiber flow behavior in the form of the respective fiber band quantity supplied to the rotor as a function of the transport path of the fiber band feed. The speed of the fiber band feed is controlled in a delayed manner from the run-up of the yarn draw-off, dependent on the rotor speed, by the fiber band function, such that the fiber shortfall quantity being produced from the fiber band function is compensated by dynamic feed addition with respect to height and length.

16 Claims, 3 Drawing Sheets

METHOD FOR PIECING A YARN AND ROTOR SPINNING MACHINE FOR CARRYING OUT THE METHOD

CROSS-REFERENCES TO RELATED APPLICATIONS

This application claims the benefit of German patent application 10 2005 059 078.0, filed Dec. 10, 2005, and corresponding International PCT Application No. PCT/EP2006/010502, each herein incorporated by reference.

BACKGROUND OF THE INVENTION

The present invention relates to a method for piecing a yarn at a rotor spinning machine and to a rotor spinning machine for carrying out such method.

With increasing demands on the yarn production process, ever higher demands are also made on the production of piecers. The process of forming piecers after yarn interruptions, the piecing, is carried out at the individual spinning stations of the open-end rotor spinning machines, generally by a piecing unit travelling along the spinning machine, the so-called piecing carriage. The piecing process is controlled by means of a piecing program.

The quality of piecers with regard to their visual appearance and strength is decisively influenced by an optimal parameterisation of the piecing program. The very complex process for determining the optimal piecing parameters until now has had to be carried out after every batch change and every change of spinning parameters, such as, for example, a change in the draft, the twist factor, the rotor speed and the like. An adequately good adjustment can often only be found after hours even with experienced users. This task is made more difficult when spinning fine yarns with high yarn counts. In the case of small yarn diameters, for example 0.2 mm with a yarn count Nm 50, it is no longer possible without a mechanical visual display of the yarn diameter for the user to visually detect the fluctuations occurring in the $100^{th}$ of a millimeter range.

An important reason for the outlay for optimisation is due to the circumstance that during piecing, the fiber flow is only available in a delayed manner and not 100%. This is to be attributed to the procedure in principle during piecing.

Thus, after a process triggering the piecing, such as, for example, a yarn break or a bobbin change, the yarn band feed is switched off. The trailing opening roller, however, still releases fibers from the fiber tuft. In order to achieve the same conditions and therefore a prefeed quantity which is as far as possible the same, before each piecing process, the fiber tuft is evened out. Up to the piecing, fibers continue to be combed from the fiber tuft, so the fiber tuft is shortened.

The prefeed to form a fiber ring takes place for a predetermined time and is then switched off. In this case, the quantity of fed-in fibers as well as the duration of the prefeed can also be controlled by the adjustment of the feed speed. The process of piecing begins with the rotor start. On reaching a preadjusted piecing rotor speed, feeding in of fibers begins. In this case, a certain delay occurs in reaching the required fiber flow and possibly causes a diameter deviation after the piecer. Therefore, the fiber feed is already switched on again shortly before the start of the yarn draw-off. The draw-off speed then has a value which corresponds to the instantaneous rotor speed when maintaining the desired twist of the spun yarn. Until the operating rotor speed is reached, the draw-off speed follows the increase in the rotor speed.

Apart from the follow-up movement of the fiber flow after switching off the feed and the delayed starting up after switching on the feed, the fiber flow can also react with a delay when increasing the feed speed. This can lead to diameter fluctuations of the yarn occurring after the piecer. In order to avoid these undesired diameter fluctuations, a so-called feed addition is carried out.

When piecing, it is attempted by means of the feed addition to ensure that 100% of the required quantity of fiber is present in the rotor at every draw-off instant. The feed addition thus compensates the temporary shortfall quantity through a higher feed speed. A linear increase in the fiber flow is assumed here. The optimisation of the piecer inter alia assumes knowledge of the parameters: addition length, addition quantity and advance time of the feed, the necessary advance time of the feed being assumed to be constant with a predetermined spinning geometry. One is in a position to determine the addition length owing to suitable technical aids and the use of software for visually displaying the piecer profile.

A piecing mechanism is known from German Patent Publication DE 199 55 674 A1 set up for determining the length of the feed addition required to compensate the diameter deviation from the determined length of the diameter deviation. For this purpose, a predeterminable number of test piecers is produced without feed addition, but with reduced drafting, the number of which is determined as a function of the level of the nominal drafting.

German Patent Publication DE 199 55 674 A1 proceeds from a prior art, in which the yarn diameter in the region of the piecer is also evaluated. However, a feed addition is worked with there from the start in order to obtain, as far as possible from the beginning, piecers which can at least be used. An empirical value is used as the starting point for the addition, and is based on the average staple length. In the case of staple length distributions of natural fibers, which correspondingly fluctuate this leads in the first place to a relatively high degree of imprecision. A longer optimisation phase follows this first piecer, in which additional influences, such as the opening roller clothing, opening roller speed, rotor run-up time etc. are to be compensated and this makes the empirical determination relatively protracted. Furthermore, the result of this optimisation is only to some extent satisfactory with a very high outlay.

In contrast, German Patent Publication DE 199 55 674 A1 provides an algorithm, by means of which the length of the thin point is determined with the aid of test piecers which are produced without feed addition. So that these test piecers can be produced at all with a definite thin point at the end of the piecer, the draft is reduced for these test spinners to obtain a pieceable yarn end. This draft reduction has again to be calculated by a suitable algorithm to obtain the actual values for the thin point.

The basic information of German Patent Publication DE 199 55 674 A1 is that exclusively the length of the thin point is to be used to determine the feed addition. For this purpose, an average test piecer is calculated from a large number of individual test piecers and the increase in the yarn thickness is represented by a straight line, the point of intersection of which with the horizontal representing the normal yarn thickness is to embody the end of the thin point. The distance between the beginning of the piecer and this point of intersection is then defined as the addition length and the addition is then determined. This solution is clearly an improvement compared to the previously characterised prior art but is in need of improvement with regard to approaching the optimum of the piecer. The necessary addition level to determine the feed addition then has to be determined empirically however, which is liable to undesired imprecisions.

Because of the imprecisions occurring, the result of these measurements cannot, however, be transferred to other machines provided to process the same fiber band material and to adjust the piecing parameters.

Alternatively, the determination of the fiber flow behaviour may take place under laboratory conditions by means of video recordings of the fiber flow in the fiber guide channel. The high technical outlay does not allow this method to be used at every machine. Furthermore, the determination of the fiber flow behaviour has to be carried out again at each change of the fiber band.

Moreover, the actual effects of the fiber flow behaviour on the yarn are not detected with the two methods as the fiber flow cannot be determined at the site of the yarn formation because the interior of the rotor is not accessible for measurement purposes during operation. In addition, the two methods disregard the doubling back taking place in the rotor.

SUMMARY OF THE INVENTION

The invention is therefore based on the object of providing a method for piecing the yarn, by means of which the parameterisation of a spinning process is simplified, as well as to proposing a rotor spinning machine, which is set up to carry out the method.

This object is achieved according to the invention by a method for piecing a yarn at a rotor spinning machine comprising a plurality of spinning stations, in which a fiber band is supplied by a fiber band feed from a band supply, is opened by means of an opening mechanism and is supplied as a single fiber flow to the spinning rotors, and in which the yarn spun in the spinning rotor is drawn off by a draw-off device from the spinning rotor. At least one control device for detecting and evaluating data from an automatic piecing process is provided at least one spinning station. As well, at least one sensor device for measuring the yarn diameter and for detecting the position of the associated measuring point of a piecer produced during the piecing process is provided at least one spinning station. The successive production of a plurality of piecers is controlled by means of the control device in a measuring phase without feed addition and with reduced drafting. The method of the present invention is characterised by successively producing more than five piecers in the measuring phase and the coordinates of the measurement values together with the associated measurement values from the individual measurements of the piecers are supplied for an evaluation for averaging and for determining a fiber band function taking into account the drafting reduced for the measurement values, which reflects the fiber flow behaviour in the form of the respective fiber band quantity supplied to the rotor as a function of the transport path of the fiber band feed. The speed of the fiber band feed is controlled in a delayed manner from the run-up of the yarn draw-off, which is dependent on the rotor speed, by means of the fiber band function, in such a way that the fiber shortfall quantity being produced from the fiber band function is compensated by dynamic feed addition with respect to height and length.

The invention also provides a rotor spinning machine for carrying out the above-described method, with a plurality of spinning stations, at least one control device for detecting and evaluating data of an automatic piecing process at least one spinning station as well as at least one sensor device for measuring the yarn diameter and for detecting the position of the associated measurement point of a piecer produced during the piecing process. The textile machine has a control device which is set up to control the successive production in a measuring phase of a plurality of piecers without a feed addition and with reduced drafting. The rotor spinning machine is characterised in that the control device is set up to automatically carry out the measuring phase and for evaluation and averaging to determine the fiber band function.

According to the present method, it is provided that in the measuring phase, successively more than five piecers are produced, in that the coordinates of the measurement values together with the associated measurement values from the individual measurements of the piecers are supplied for evaluation to average and to determine a fiber band function taking into account the reduced drafting for the measurement values, which reflects the fiber flow behaviour in the form of the fiber band quantity supplied in each case to the rotor as a function of the transport path of the fiber band feed, and in that the speed of the fiber band feed is controlled in a delayed manner by means of the fiber band function from the run-up of the yarn draw-off which is dependent on the rotor speed, in such a way that the shortfall quantity of fiber produced from the fiber band function is compensated by dynamic feed addition with respect to height and length.

The fiber band function determined after the measuring phase allows determination of the fiber band weight available for each feed path and the instantaneous speed of the feed produced from this feed path in any desired combinations of adjustments of the spinning parameters. In this case, the fiber band function determined according to the invention takes into account the fiber flow behaviour subject to a series of influences, the main influence of which is produced from the natural shortwave and longwave scatterings of the fiber band and has an effect in the point of origin of the yarn, in the spinning rotor. The determination of the fiber band function can substantially simplify the parameterisation of the piecing process as the fiber flow behaviour decisively influencing the piecing process is taken into account by this function. Staff who are trained in a certain manner and are experienced and have to empirically determine the parameters, or the requirement for expensive laboratory investigations and measuring equipment to determine the parameters, such as is necessary in the prior art, are unnecessary. A high quality of the piecer is achieved by the dynamic feed addition of the missing fiber band quantity which depends on the course of the fiber band function. The fiber band function describes the fiber flow behaviour at the site of the yarn formation, in the rotor, and takes into account the doubling back taking place in the rotor of the yarn being formed.

Moreover, a fiber band characteristic value can be calculated from the fiber band function and is independent of a variation of the spinning parameters and/or spinning means and reflects the fiber flow behaviour. The fiber band characteristic value is used for a simplified description of the fiber band function. A renewed calculation of the fiber band characteristic value or determination of the fiber band function therefore is only necessary upon a fiber band change as a result of a batch change with a different fiber band material as the fiber flow behaviour can change as a function of the fiber band material used. If only the spinning parameters and/or the spinning means, such as, for example, the rotor, the opening roller speed, the twist factor or the draft are changed, without changing the fiber band material, a repetition of the determination of the fiber band function is no longer necessary as the fiber band characteristic value or the fiber band function also retains its validity for changed spinning parameters, such as the draft, the rotor speed, the twist factor and the like. Owing to automation of the determination of the fiber flow behaviour and the determination of the fiber band function or the fiber band characteristic value describing this, it can also be made possible for inexperienced operating staff to produce piecers of high quality without having to carry out a complex optimisation phase. Only one process has to be initiated which carries out the determination of the fiber band function. By producing the yarn profile of an averaged piecer the determination of a reliable fiber band characteristic value can be achieved even after a few piecers to be produced in the measuring phase.

The time delay between the yarn draw-off and the fiber band feed, which is produced from the geometric structure of the assemblies involved in the spinning process, can be determined by measurement. In this case, the speed courses of the feed drive and the draw-off drive can be synchronised during the measuring phase taking into account the draft. As a result, the influence of the delay occurring when switching on the drive of the fiber band feed is taken into account. The speed of the feed drive is calculated as a function of the rotor speed at the instant of the draw-off, the rotation and the draft. To determine the rotor speed at the instant of the draw-off, the measured speed increase of the rotor during the run-up can be used.

In particular, the reduced draft in the measuring phase should be selected such that the diameter of the spun yarn is not less than 70% of the averaged yarn diameter. This ensures that the diameter deviations produced in the measuring phase after the piecer has an adequate characteristic and allow suitable assessment of the averaged piecer profile from the piecers. Drafts which are too great would lead to a flat rise in the piecer profile after the thin point of the averaged piecer and make piecing more difficult, while in the case of drafts which are too small, the rise lies within the first rotor periphery and therefore the rise in the piecer profile after the thin point of the averaged piecer is concealed thereby. The spinning drafts are preferably halved.

Furthermore, the piecers produced in the measuring phase should be discarded. For this purpose, the piecers produced during the measuring phase can be extracted by a suction device after they have been detected. This ensures that the piecers produced in the measuring phase with the reduced draft do not arrive on the cross-wound bobbin to be produced. Alternatively, the piecers produced during the measuring phase can be unwound from the bobbin before the next piecing process.

Furthermore, the sensor device can be calibrated before each piecing process. In this manner, external influences caused, for example, by finish or fine dust and the like which influence the measuring precision in the form of a basic shading, can be taken into account.

In particular, a yarn length should be measured in the measuring phase for the respective piecer, which, as a function of the selected draft, corresponds to a minimum fiber band length. This is used to detect all the fluctuations occurring of the yarn diameter, for example thick and thin points of the yarn, which can be caused by the natural diameter fluctuations of the fiber band, or the like, over a yarn length, which, because of the selected draft corresponds to a certain fiber band feed.

The fiber band function can preferably be defined as an exponential function, in particular as an e-function. The exponential function used as a basis to describe the fiber band function more precisely reflects the course of the yarn profile of the averaged piecer than the linearisation carried out according to the prior art of the yarn diameter deviation in the region after the piecer, and is therefore more suited to describe the fiber flow behaviour.

In an advantageous development of the method according to the invention, the fiber band function can be calculated to compensate yarn diameter fluctuations as a function of various threshold values.

According to the rotor spinning machine of the invention, it is proposed that the control device should be set up to carry out the measuring phase and the evaluation to average and determine the fiber band function. The degree of automation for the automatic piecing can be increased by the control device according to the invention. In addition, the parameterisation of the piecing process is simplified and can be carried out more rapidly compared to the prior art.

For this purpose, the at least one spinning station can be designed as a pilot spinning station set up to carry out the method, which is used to determine the fiber band function on a change in the fiber band used. At the pilot spinning station, the fiber band function can be determined for a pending batch change, in which a fiber band is used with different properties to the fiber band processed up until then. The piecing parameters are determined from the fiber band function determined for the fiber band or from the fiber band characteristic value describing this and then passed to the spinning stations, at which the new fiber band is to be processed. An individual spinning station for the entire rotor spinning machine and also one spinning station per section of the rotor spinning machine may be designed as a pilot spinning station.

Owing to the automation of the determination of the fiber flow behaviour and the calculation of the fiber band characteristic value describing the fiber band function it is also made possible for inexperienced staff to produce piecers of high quality without having to carry out a complex optimisation phase. A process merely has to be initiated at the control device which carries out the automatic determination of the fiber band function. A reliable fiber band function or a fiber band characteristic value describing this can be determined after a few piecers to be produced in the measuring phase, owing to the automatic production of the yarn profile of an averaged piecer.

To carry out the method according to the invention, the control device can control the measurement and averaging of the reference yarn. The reference yarn diameter determined in this manner is used as a basis for standardising the yarn diameter of the piecers measured in the subsequent measuring phase. Thus, in the measuring phase, a reference yarn diameter to be used as a basis to calculate the fiber band characteristic value is present and is used as a basis in assessing the yarn diameter deviation during piecing. Furthermore, the control device can control the measurement, evaluation and averaging of the yarn diameters of the at least five piecers produced in the measuring phase. Thus, the acquiring, evaluation and processing of the data determined takes place at a central location of the rotor spinning machine.

The control device may preferably be connected to a control mechanism of the respective spinning station by means of an operative connection, for example in the form of a bus system or by means of wirelessly communicating mechanisms. Furthermore, the rotor spinning machine may comprise at least one piecing mechanism, in which the control device is integrated. Alternatively, each spinning station may comprise a piecing mechanism, in which the control device is integrated.

BRIEF DESCRIPTION OF THE DRAWINGS

Further details of the invention are described with the aid of views of the figures, in which.

DETAILED DESCRIPTION OF THE PREFERRED EMBODIMENTS

Figure 1:
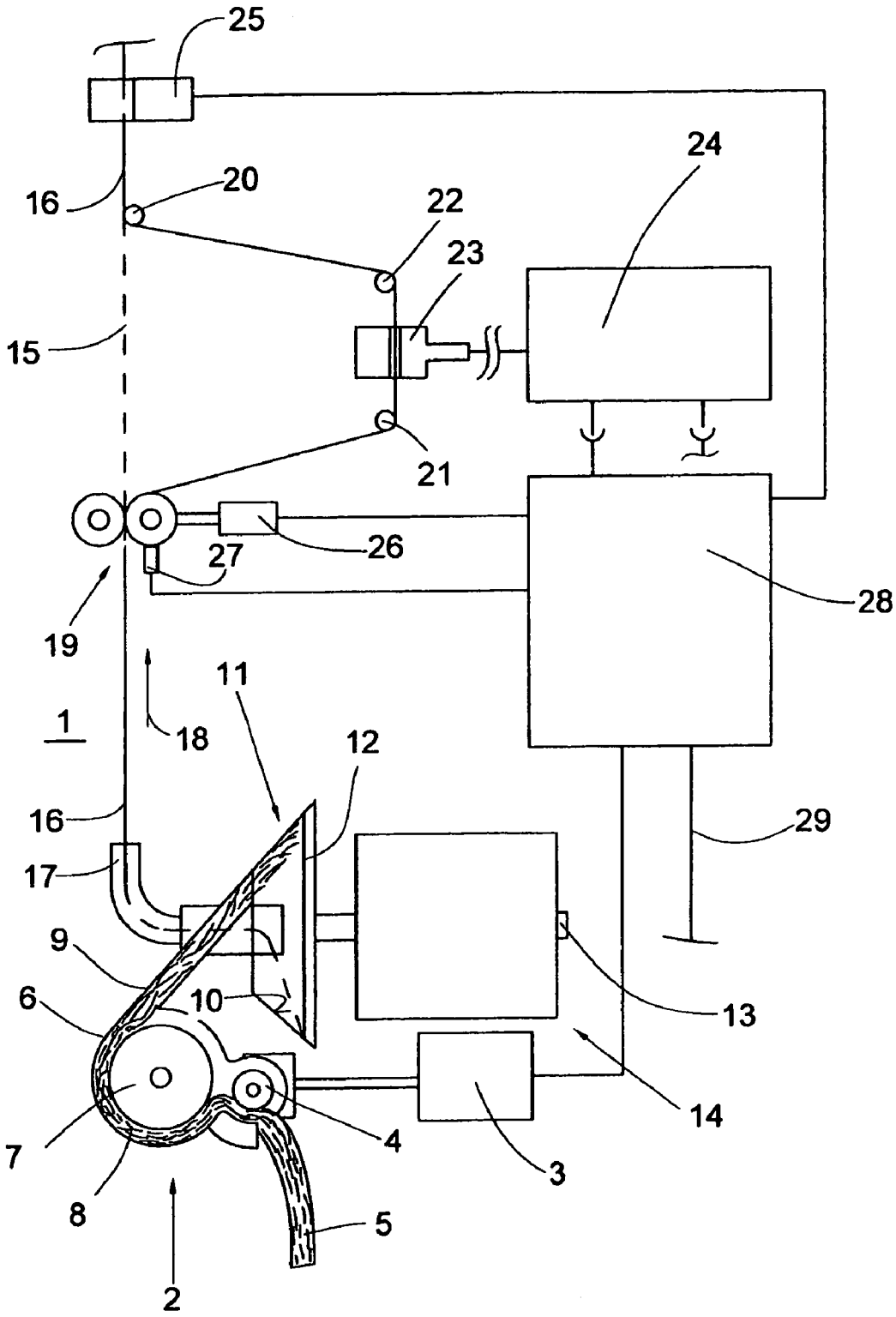
FIG. 1 shows a simplified schematic view of a spinning station of an open-end rotor spinning machine.

FIG. 1 schematically shows a side view of one half of an open-end rotor spinning machine producing cross-wound bobbins.

Rotor spinning machines of this type have, as known, between their end frames (not shown), a large number of similar spinning stations 1, the components of which are driven by a single motor. The spinning station 1 has an opening device 2, into which a fiber band 5 is introduced by means of the feed roller 4. The feed roller 4 is driven by a continuously adjustable feed motor 3. The fiber band 5 is fed to an opening roller 7 rotating in the housing 6 and driven by a single motor and which opens the fiber band 5 supplied into individual fibers 8.

The separated fibers 8 arrive through the fiber guide channel 9 onto the conical slip face 10 of a spinning rotor and from there into the fiber collecting groove 12. From the fiber collecting groove 12, the spun yarn 16 is drawn through the fiber draw-off tube 17 in the direction of the arrow 18 with the aid of a draw-off mechanism 19. The spinning rotor 11 is fastened on a shaft 13 which is preferably configured as an external rotor of a single motor drive 14.

The draw-off mechanism 19 for the spun yarn 16 has a pair of rollers, between which the yarn 16 to be drawn off is guided. During the normal spinning operation, the yarn 16 after the draw-off mechanism 19 follows the dashed line 15 and is then wound onto a cross-wound bobbin, not shown here. For automatic piecing, a piecing unit which can be moved along the rotor spinning machine is delivered to the spinning stations 1 and carries out the automatic piecing process. The piecing unit is not shown in more detail here for reasons of simplification. In an alternative embodiment of the rotor spinning machine, it is provided that each spinning station has suitable mechanisms which carry out the automatic piecing without the use of one or more movable piecing units being necessary.

After completion of the piecing process, it can be checked whether proper piecing has taken place. For this purpose, the yarn 16 is guided section-wise in the piecing unit, which is indicated schematically by the yarn deflection between the draw-off mechanism 19 and a yarn guide 20. The yarn 16 in this case runs in the piecing unit, not shown in more detail, between two further yarn guides 21 and 22 through a sensor device 23, with which the yarn diameter is continuously measured during the piecing process. The test signals for the length-related yarn diameter measurement values are supplied to a control device 24 of the piecing unit. A clearer 25 is arranged in the yarn course downstream from the yarn guide 20. The clearer 25 comprises a sensor device 23 which monitors the occurrence of diameter fluctuations of the yarn 16 and if necessary emits a yarn interruption signal. If a yarn interruption signal is emitted by the clearer 25 this leads to a feed interruption of the fiber band 5.

In an alternative embodiment, the clearer 25 and the sensor device 23 can be configured as an assembly belonging together, which is provided at each spinning station 1. The arrangement of this assembly may preferably be provided in the region between the yarn draw-off tube 17 and the draw-off mechanism 19. The spun yarn 16 is held under tension by the draw-off mechanism 19, so a precise measurement of the yarn diameter is ensured.

The checking of the yarn diameter takes place during the run-up of the spinning rotor 11 at the accelerated yarn 16. After the piecing, the yarn 16, in accordance with the increasing spinning rotor speed, is drawn off at an increasing speed from the yarn draw-off tube 17 by means of the draw-off mechanism 19. So that the measurement frequency of the sensor device 23 can be adjusted to the changing speed of the accelerating yarn 16, pulses are picked up by means of a sensor 27 from the yarn draw-off roller of the draw-off mechanism 19 driven by a drive 26. These pulses provide information about the draw-off speed and the length of the yarn 16. The sensor signals are supplied to the control device 24 which controls the measurement frequency of the sensor 27 and adapts it to the yarn draw-off speed. The yarn draw-off speed can alternatively, for example, be determined by a contactless measurement directly at the yarn 16. The control device 24 is connected to a control mechanism 28 of the spinning station 1. The control mechanism 28 is connected via the line 29 to further modules of the rotor spinning machine.

The process of automatic piecing assumes an optimal parameterisation of the piecing program to be worked by the piecing unit. To simplify and automate the process of parameterisation, according to the invention, a fiber band function, which describes the fiber flow behaviour, is determined for automatic parameterisation, the flow behaviour being influenced mainly by the natural shortwave and longwave scatterings of the fiber band 5. The fiber band function reflects the fiber flow behaviour in the form of the fiber band quantity supplied in each case to the spinning rotor 11 as a function of the transport path of the fiber band feed.

To determine the fiber band function describing the fiber flow behaviour, a yarn length of at least 400 m is firstly spun in advance in a test phase. The yarn diameter is measured via this yarn length by the sensor mechanism 23 and passed to the control device 24.

An average is formed from the measurement values for the yarn diameters determined in the test phase and is used for further assessment as the reference yarn diameter. The reference yarn diameter which represents a yarn diameter of 100% is used for standardisation of subsequently measured yarn diameters. For the required piecer of the reference yarn to be produced, the feed addition is adjusted during the test phase in a manner known from the prior art (Raasch et al "Automatisches Anpinnen beim OE-Rotorspinnen", Melliand Textilberichte 4/1989, pages 251 to 256).

The following measuring phase is carried out without feed addition in contrast to the preceding test phase. To allow the piecing without feed addition, the draft is reduced, wherein the yarn diameter of the diameter deviation produced after the piecer should not be less than 70% of the reference yarn diameter. In the present embodiment, the draft is reduced by 50% in that the feed speed of the fiber band 5 is doubled.

To ensure that with the beginning of the yarn draw-off the required yarn quantity for piecing is always available in the spinning rotor 11 the feed has to be in advance of the draw-off by a defined time span. The course of the run-up function of the feed motor 3 virtually precisely follows the course of the run-up function of the drive 26 of the draw-off mechanism 19. In order to ensure the coinciding speed course and the preciseness connected therewith of the following measurements in the measuring phase, the speeds of the feed motor 3 and the drive 26 are synchronised. The feed speed $f_{eed}$ is calculated according to the formula:

$$f_{eed} = \frac{n_{rotor}}{\text{rotation} * \text{draft}}.$$

Here, the "rotation" describes the number of rotations on 1 meter of yarn 16 and $n_{rotor}$ describes the rotor speed at the instant of the draw-off. The calculation of the feed speed $v_{feed}$ therefore assumes knowledge of the rotor speed $n_{rotor(start\ draw\text{-}off)}$ at the instant of the draw-off of the yarn 16. The rotor speed $n_{rotor(start\ draw\text{-}off)}$ is determined by a calculation of the rotor speed to be expected as a function of the speed increase according to the following formula:

$$N_{rotor(start\ draw\text{-}off)} = n_{rotor(start\ feed)} + (n_{rotor(increase)} * \text{advance time}).$$

Here, $n_{rotor(start\ draw\text{-}off)}$ reflects the rotor speed to be determined at the instant at the beginning of the draw-off, $n_{rotor(start\ feed)}$ reflects the rotor speed at the instant of the beginning of the feed and $n_{rotor(increase)}$ describes the increase in the rotor speed over the time period of the run-up of the spinning rotor 11 until the operating speed is reached. The advance time gives the time span by which the feed motor 3 has to be in advance of the drive 26 of the draw-off mechanism 19 to provide fiber material for the piecer.

Before the beginning of the measuring phase and after each completed measurement during the measuring phase, a calibration of the sensor mechanism 23 is carried out. This takes place in such a way that a measurement is carried out with the sensor device 23 without the yarn 16 being supplied thereto to thus determine the existing basic shading due to the finish or other impurities, such as fine dust particles and the like. In this manner, the influences influencing the measurement result are taken into account during the subsequent measurements of the yarn diameter by means of the sensor device 23.

To carry out the measuring phase described below, the drive of the cross-wound bobbin to be wound and the yarn guide 20 are put out of operation. The piecers produced in the measuring phase and the yarn lengths following the piecers are guided away via the yarn draw-off tube 17. In this manner it is ensured that the yarn 16 which is newly spun during the measuring phase with half the yarn count is not used as piecing yarn.

The measuring phase begins with the start of drawing off the yarn 16 when the rotor 11 has reached the minimum speed required for piecing. In this case, about 7 meters of the yarn 16 are spun and the yarn diameter thereof recorded by the sensor device 23. The averaged measurement values of the yarn diameters of the measuring phase are then standardised in each case by means of the reference yarn diameter already determined in the test phase.

Figure 2:
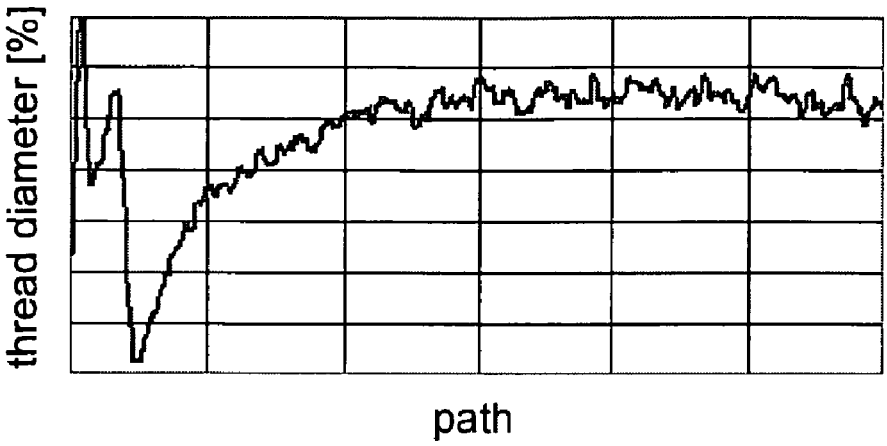
FIG. 2 shows an averaged piecer profile from a plurality of piecers.

The total measuring phase is repeated at least 5 times to be able to determine a significant fiber band function. From the recorded and standardised yarn diameter values of the piecers, an averaged piecer is formed. For further evaluation, the yarn length before the averaged piecer remains disregarded and does not enter the subsequent determination of the fiber band function. For evaluation, a yarn profile is now used which begins with the averaged piecer, as shown in FIG. 2.

Figure 5:
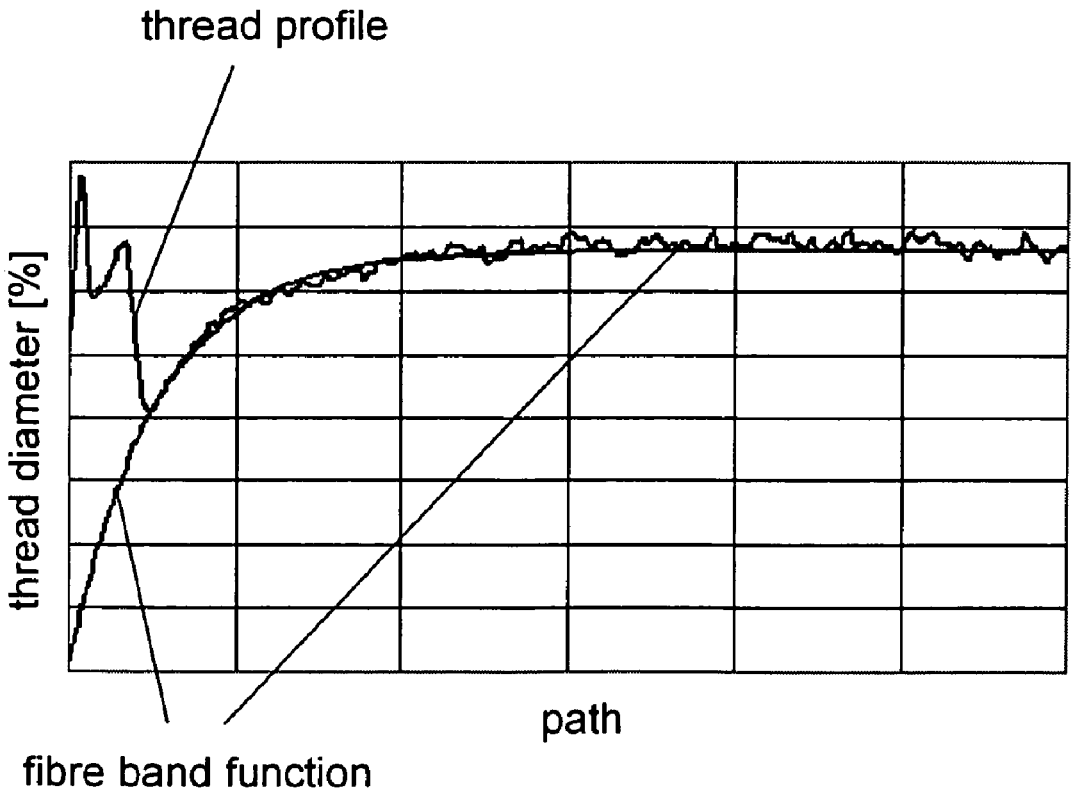
FIG. 5 shows a course of a fiber band function for the averaged piecer profile.

The averaged piecer, in its course of the yarn profile, has a clear diameter deviation, from the course of which the fiber band function describing the fiber flow behaviour is calculated below. The course of the yarn profile of the averaged piecer in the region of the diameter deviation can be represented substantially by the course of an exponential function, in particular an e-function. FIG. 5 shows the course of the yarn profile of the averaged piecer and the course of the corresponding fiber band function.

To determine the fiber band function, firstly the X and Y coordinate of the minimum value of the yarn profile of the averaged piecer is determined. The calculation of threshold values Y for various percentage deviations of the reference yarn diameter then takes place. The threshold values Y represent various percentage yarn diameters as a function of various tau values. The tau values describe the course of the exponential function for a value range of tau=1 to 5. Thus the value tau=1 corresponds to the reaching of a yarn diameter of 63%. The calculation of the threshold value Y takes place according to the following formula:

$$Y(\text{tau}) = (1 - e^{-tau}) * \text{yarn average}_{rotor\ run\text{-}up}.$$

The value for the yarn $\text{average}_{rotor\ run\text{-}up}$ is produced from the averaged yarn diameter which is measured at the end of the rotor run-up in the measuring phase and is related to the standardisation to the reference yarn diameter. The calculation takes place according to the formula:

$$\text{Yarn } average_{rotor\ run\text{-}up} = \frac{\text{averaged thread diameter after rotor run-up}}{\text{reference thread diameter}}.$$

Figure 3:
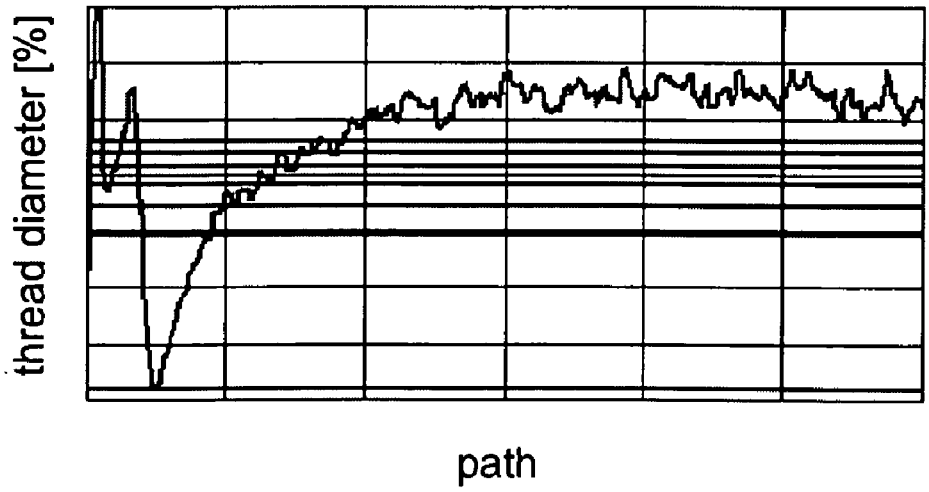
FIG. 3 shows the averaged piecer profile according to FIG. 2 with different tan values drawn therein.

After the threshold values Y have been calculated for various values of tau, the calculated threshold values Y are compared with the actual course of the yarn profile of the averaged piecer. For this purpose, in the event of the calculated threshold values Y being exceeded, the corresponding X coordinate is determined from the graph representing the course of the yarn profile of the averaged piecer (FIG. 3). In this manner, a corresponding X-value is determined for each tau value.

In order to transfer these intermediate results into a comparable interrelationship, the yarn length s is firstly calculated as a function of the threshold values Y and the determined values of the X coordinate of the respective threshold value Y for the respective tau values. The yarn length s represents the spacing between the smallest yarn diameter and the x coordinates when exceeding the respective threshold value Y. The calculation takes place according to the following fiber band function:

$$S(x, Y) = \frac{X(\text{tau})}{\left(\ln\left(1 - \left(\frac{Y(\text{tau})}{\text{thread average } rotor_{run\text{-}up}}\right)\right) * (-1)\right)}$$

Figure 4:
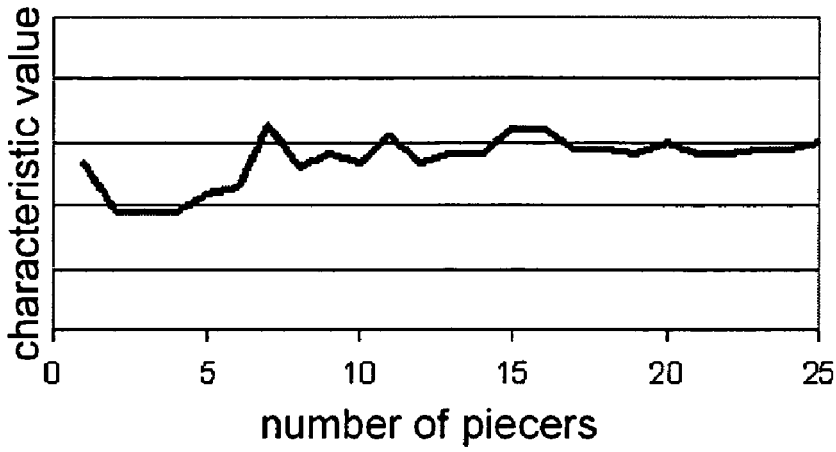
FIG. 4 shows the course of a fiber band characteristic value for the averaged piecer profile.

A yarn length average value $s_M$ is then formed from all the yarn lengths s(X, Y) calculated by means of the yarn band function. The yarn length average value $s_M$ is divided by the reduced drafting used in the measuring phase, producing a fiber band characteristic value $s_{FBK}(X, Y)$ for a value tau=1. For this, as shown in FIG. 4, the fiber band characteristic values $s_{FKB}(X, Y)$ determined according to the fiber band function s(X, Y) are plotted over the number of piecing attempts. The fiber band characteristic value produced approximately from the tenth piecing attempt moves by a constant value so the fiber band characteristic can be assumed to be approximately constant.

The fiber band weight $actual_{fiber\ band\ weight}$ available can now be calculated for each feed path $s_{feed}$ of the fiber band 5 via the fiber band characteristic. The calculation takes place according to the formula:

$$Actual_{fiber\ band\ weight} = \frac{1{,}000}{\text{roving count}} * \left(1 - e^{\left(\frac{-s_{feed}}{fibre\ band\ characteristic}\right)}\right)^2.$$

In order to ensure that during piecing at every draw-off instant the actually required fiber quantity is present in the spinning rotor 11, the feed motor 3, as already described, has to be in advance of that of the drive 26 of the draw-off mechanism 19 by the required comb-out time. Basically, the drive function of the feed motor 3 follows the drive function of the drive 26. For this it is necessary to emulate the drive function of the drive 26 of the draw-off mechanism 19 for the drive function of the feed motor 3. In this case, apart from the acceleration function, functional additions also have to be taken into account, such as, for example, the additional rotation, which leads to a reduction in the draw-off speed compared to the rotor speeds $n_{rotor}$ if, because of the lower rotor speeds during piecing, the situation arises that the spinning tension on the yarn 16 is less than normal, so the friction and therefore the false twist effect at the draw-off nozzle is not sufficient for a stable running state. The drive function of the feed motor 3 is determined by means of the fiber band function s(X, Y).

As the draw-off speed $v_{draw\text{-}off}$ of the yarn 16 and the acceleration of the draw-off are known at every instant and therefore also the draw-off path $s_{draw\text{-}off}$, the feed speed is determined as a function of the draw-off path $s_{draw\text{-}off}$ and the time $t_{part\ section}$ required to spin a part section, of the fiber band 5. The yarn feed path $s_{feed}$ is determined for each draw-off path $s_{draw\text{-}off}$ of the yarn 16 from the currently combed-out fiber band weight $actual_{fiber\ band\ weight}$, which is calculated according to the aforementioned formula, and from the desired weight, which is produced from the reciprocal value of the yarn count. The yarn draw-off path $s_{feed}$ is determined according to:

$$s_{feed} = \frac{actual_{fibre\ band\ weight}}{\text{desired weight}} = actual_{fiber\ band\ weight} * \text{yarn count}.$$

The time $t_{part\ section}$ for spinning a part section is determined from the yarn draw-off path $s_{draw\text{-}off}$ and the instantaneous draw-off speed $v_{draw\text{-}off}$. The time $t_{part\ section}$ for spinning a part section is calculated as follows:

$$t_{part\ section} = \frac{s_{draw\text{-}off}}{v_{draw\text{-}off}}.$$

The instantaneous feed speed $v_{feed}$ of the fiber band 5 can be calculated from the time $t_{part\ section}$ calculated in this manner and the feed path $s_{feed}$ of the fiber band feed. Accordingly, the feed speed of the fiber band 5 can be calculated according to the formula:

$$v_{feed} = \frac{s_{feed}}{t_{part\ section}}.$$

Thus the parameters required for automatic piecing can be determined from the automatically determined fiber band function or from the fiber band characteristic value automatically determined from the fiber band function, it being possible to use the fiber band characteristic value as a basis for the automatic determination of the piecing parameters independently of a change in spinning parameters or the spinning means, for example when using a rotor with a larger or a smaller diameter than that used to calculate the fiber band characteristic value.

The invention claimed is:

1. Method for piecing a yarn at a rotor spinning machine comprising a plurality of spinning stations (1), in which a fiber band supplied by a fiber band feed from a band supply and opened by means of an opening mechanism is supplied as a single fiber flow to the spinning rotors and the yarn spun in the spinning rotor is drawn off by a draw-off device from the spinning rotor, with at least one control device (24) for detecting and evaluating data from an automatic piecing process at least one spinning station (1) as well as at least one sensor device (23) for measuring the yarn diameter and for detecting the position of the associated measuring point of a piecer produced during the piecing process, the successive production of a plurality of piecers being controlled by means of the control device (24) in a measuring phase without feed addition and with reduced drafting, characterised in that in the measuring phase, successively more than five piecers are produced, in that the coordinates of the measurement values together with the associated measurement values from the individual measurements of the piecers are supplied for an evaluation for averaging and for determining a fiber band function taking into account the drafting reduced for the measurement values, which reflects the fiber flow behaviour in the form of the respective fiber band quantity supplied to the rotor as a function of the transport path of the fiber band feed, and in that the speed of the fiber band feed is controlled in a delayed manner from the run-up of the yarn draw-off, which is dependent on the rotor speed, by means of the fiber band function, in such a way that the fiber shortfall quantity being produced from the fiber band function is compensated by dynamic feed addition with respect to height and length.

2. Method according to claim 1, characterised in that a fiber band characteristic value is calculated from the fiber band function and is independent of a variation of the spinning parameters and/or the spinning means and reflects the fiber flow behaviour.

3. Method according to claim 1, characterised in that the time delay between the yarn draw-off and fiber band feed, which is produced from the geometric structure of the assemblies involved in the spinning process, is determined by measurement.

4. Method according to claim 1, characterised in that the speed courses of the feed drive and the draw-off drive are synchronised during the measuring phase taking into account the draft.

5. Method according to claim 1, characterised in that the piecers produced in the measuring phase are discarded.

6. Method according to claim 5, characterised in that the piecers produced during the measuring phase are extracted by a suction device after they have been detected.

7. Method according to claim 5, characterised in that the piecers produced during the measuring phase are unwound from the bobbin after they have been detected.

8. Method according to claim 1, characterised in that the sensor device (24) is calibrated before each piecing process.

9. Method according to claim 1, characterised in that the draft reduced in the measuring phase is selected such that the spun yarn diameter is not smaller than 70% of the averaged yarn diameter of the test phase.

10. Method according to claim 1, characterised in that a yarn length is measured in the measuring phase for the respective piecer and as a function of the selected draft corresponds to a minimum fiber band length.

11. Method according to claim 1, characterised in that the fiber band function is defined as an exponential function.

12. Method according to claim 1, characterised in that the fiber band function is calculated to compensate yarn diameter fluctuations as a function of various threshold values (Y).

13. A rotor spinning machine comprising a plurality of spinning stations (1), each having a band supply for feeding a fiber band, a fiber opening mechanism for opening the fiber band into a single fiber flow, a spinning rotor for spinning the fiber flow into a yarn, and a draw-off device for withdrawing the yarn from the spinning rotor, at least one control device (24) for detecting and evaluating data from an automatic yarn piecing process at least one spinning station (1) and at least one sensor device (23) for measuring the yarn diameter and for detecting the position of an associated measuring point of a piecer produced during the piecing process, the control device (24) controlling the successive production of a plurality of piecers in a measuring phase without feed addition and with reduced drafting, characterised in that the control device (24) includes means to produce successively more than five piecers in the measuring phase, means for evaluating the coordinates of the measurement values together with the associated measurement values from the individual measurements of the piecers for averaging and for determining a fiber band function taking into account the drafting reduced for the measurement values, which reflects the fiber flow behaviour in the form of the respective fiber band quantity supplied to the rotor as a function of the transport path of the fiber band feed, and means for controlling the speed of the fiber band feed in a delayed manner from the run-up of the yarn draw-off, which is dependent on the rotor speed, by means of the fiber band function, in such a way that the fiber shortfall quantity being produced from the fiber band function is compensated by dynamic feed addition with respect to height and length.

14. Rotor spinning machine according to claim 13, characterised in that the control device (24) is connected via an operative connection to a control mechanism (28) of the respective spinning station (1).

15. Rotor spinning machine according to claim 13, characterised in that the rotor spinning machine comprises at least one piecing mechanism, in which the control device (24) is integrated.

16. Rotor spinning machine according to claim 13, characterised in that each spinning station comprises a piecing mechanism, in which the control device (24) is integrated.

* * * * *